United States Patent [19]

Papazian, Sr.

[11] 4,145,049

[45] Mar. 20, 1979

[54] BOMBER GAME WITH SPRING APART TARGET

[76] Inventor: Chris C. Papazian, Sr., 7552 Woodview, Apt. 3, Westland, Mich. 48185

[21] Appl. No.: 842,732

[22] Filed: Oct. 17, 1977

[51] Int. Cl.[2] ..... A63B 63/04; A63H 27/00; F41G 1/42

[52] U.S. Cl. ..... 273/95 B; 273/102.1 C; 273/105 R

[58] Field of Search ..... 273/95 B, 102.1 C, 102 A, 273/102 AP

[56] References Cited

U.S. PATENT DOCUMENTS

| | | | |
|---|---|---|---|
| 1,559,140 | 10/1925 | Wolkenhauer | 273/101 |
| 1,912,925 | 6/1933 | Wallace | 273/95 B |
| 2,052,841 | 9/1936 | O'Donnell | 273/102.1 C |
| 2,747,874 | 5/1956 | Cappella et al. | 273/102.1 C |
| 3,853,318 | 12/1974 | Cagan | 273/102.1 C |

FOREIGN PATENT DOCUMENTS

| | | | |
|---|---|---|---|
| 954143 | 6/1949 | France | 273/95 B |

*Primary Examiner*—Richard C. Pinkham
*Assistant Examiner*—Lawrence E. Anderson

[57] ABSTRACT

An activity toy, for use by children when playing a game of war, in which a "bomb" is dropped upon a target from a height thereabove; the toy bomb being dropped either from a toy airplane, a bomb sight or a toy airplane equipped with bomb sight, while the target therebelow consists of a toy ship or the like, having a smokestack, with adjustable entry opening to challenge a player's skill for the toy bomb to enter the same; the target being comprised of parts held together by a mechanism, which is released by a successfully aimed toy bomb, so as to cause the target to fall apart.

4 Claims, 10 Drawing Figures

25
26
27
11

17
17a
12

42
43
40
44
41

2
13
15
17
16
14
24
23
2

42
12
43
44
40
41

16
17
18
15
14
14
20
19a
15
19b
21
22
22
23
24

BOMBER GAME WITH SPRING APART TARGET

This invention relates generally to toy games of war.

A principal object of the present invention is to provide a toy game called "Bombs Away", in which a toy bomb is dropped from a height down upon a target, and which, if successfully aimed, causes the target to disintegrate.

Another object of the present invention is to provide a toy game called "Bombs Away", in which the toy bomb can be dropped, either from a toy airplane, a toy bomb sight, or else a combination toy airplane and toy bomb sight, formed together.

Another object is to provide a toy game called "Bombs Away", in which the target includes a selectively adjustable opening, for being successfully entered by a toy bomb, in order to cause the target to fall apart.

Yet another object is to provide a toy game called "Bombs Away", which challenges a child's skill, in aiming a falling object toward a target.

Other objects are to provide a toy game called "Bombs Away", which is simple in design, inexpensive to manufacture, rugged in construction, easy to use and efficient in operation.

These, and other objects, will be readily evident, upon a study of the following specification, and the accompanying drawings, wherein.

Figure 1:
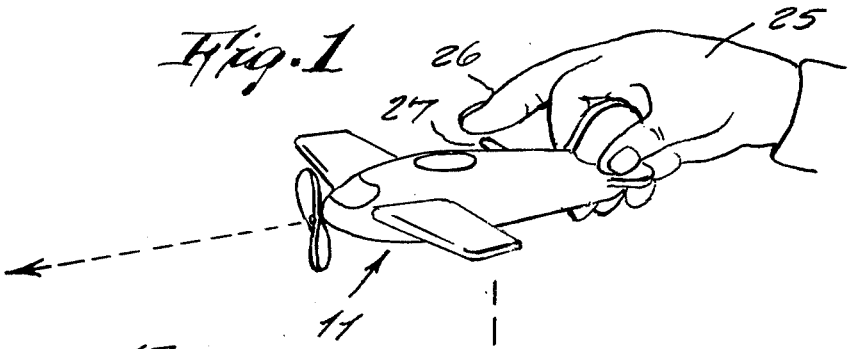
FIG. 1 is a perspective view, showing the invention in use.
Figure 3:
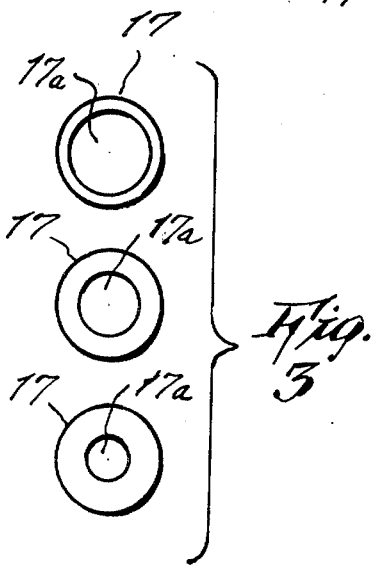
FIG. 3 is a top view of several smokestack adaptors, each with a different sized opening for being selectively used upon a target.
Figure 2:
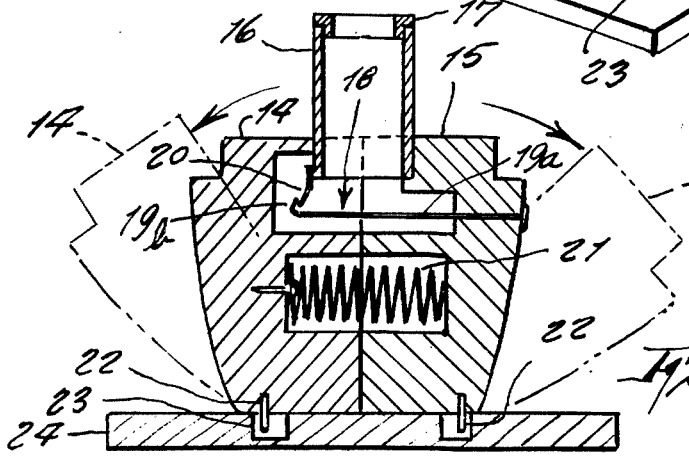
FIG. 2 is a cross-sectional view, taken on line 2—2 of FIG. 1.
Figure 6:
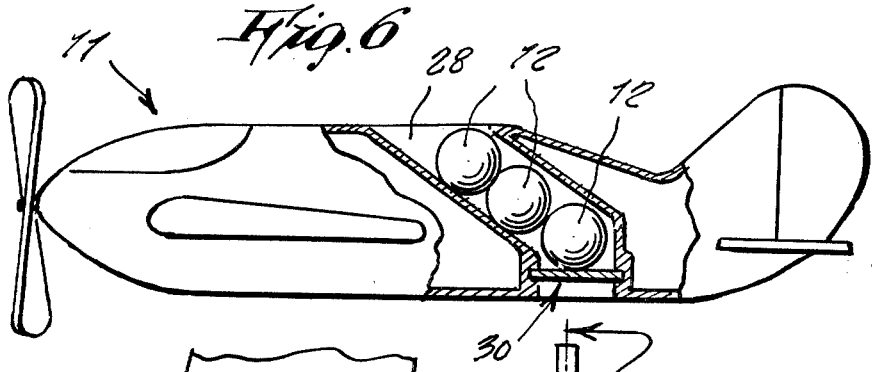
FIG. 6 is a side view of the airplane of FIG. 1, shown partly in cross-section.
Figure 7:
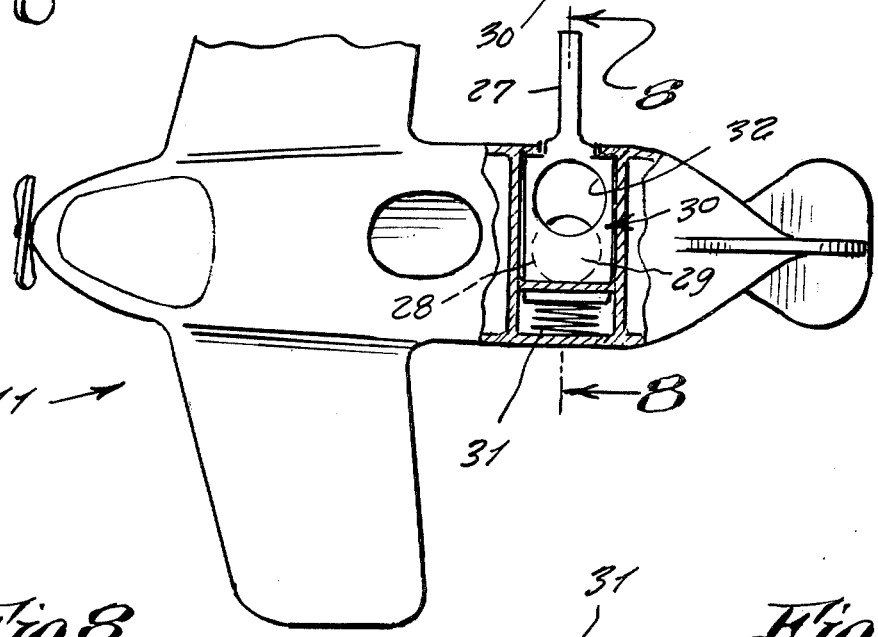
FIG. 7 is a top view thereof, also shown partly in cross-section.
Figure 8:
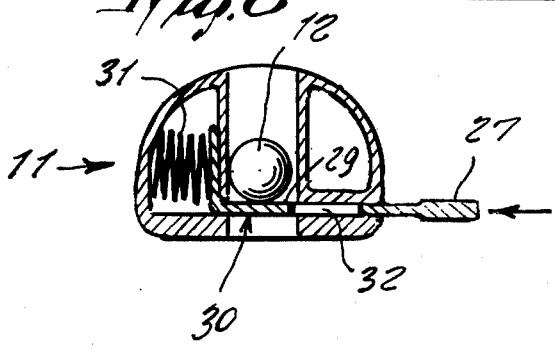
FIG. 8 is a transverse cross-sectional view, taken on line 8—8 of FIG. 7.
Figure 9:
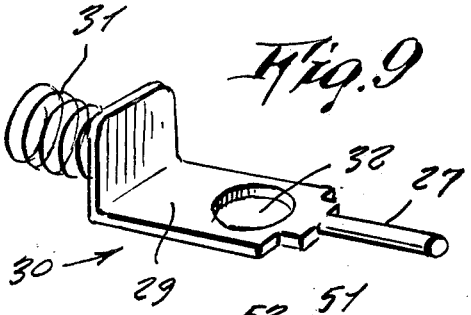
FIG. 9 is a perspective view of a slide mechanism, shown in FIGS. 7 and 8.

Referring now to the drawings in greater detail, and more particularly to FIGS. 1 to 3 thereof at this time, the reference numeral 10 represents a toy game called "Bombs Away", according to the present invention, wherein there is a toy bombing airplane 11, for dropping a toy bomb 12 from a height down upon a target 13, which comprises either a toy ship, as shown, or which alternately can be a toy factory or building, having a smokestack thereupon.

In the present invention, the toy bomb 12 comprises a spherical pellet, or marble, made of metal, so as to have weight. The target shown comprising a ship, includes right and left members 14 and 15, which together form a ship hull, the member 14 being integral with an upwardly extending smokestack 16, that is selectively fitted upon its upper end with either one of a plurality of adaptors 17, each one of which has a different sized central opening 17*a*, for receiving the toy bomb 12 therethrough, and down through the smokestack 16, so as to fall upon a catch mechanism that includes a spring steel tongue 18 secured to member 15. This flat steel tongue 18, would be bent upward at the end 19, to engage another metal piece 20, which is attached or welded to the metal half stack 16, and bent at an angle so that the tongue can slide past 20 and engage it when sides are pressed together to re-assemble. When the toy bomb strikes the latch mechanism, the bent end 19 disengages from the phrase metal piece 20, thus permitting a compression coil spring 21, within the interior of the hull, to push apart the members 14 and 15, as shown by the phantom lines in FIG. 2, which thus pivot outwardly around downward keels 22, held pivotally within grooves 23 of a ship supporting panel 24. Thus, a carefully aimed toy bomb causes the target to fall apart. The target can be subsequently reassembled, for future bombing actions.

The toy airplane 11, from which the toy bomb 12 is dropped, is held in a person's right hand 25, and a finger 26 of the hand depresses a plunger 27, so as to cause the toy bomb to be released therefrom, in order to drop downwardly.

The construction of the toy airplane 11 is shown in greater detail in FIGS. 6 through 9, and includes an angularly inclined chute 28, which is open on its upper end, so that the toy bombs can be placed therein. The chute holds several of the toy bombs, a lowermost of the bombs resting upon an upper surface 29 of a slide 30, which, at one end, is integral with the plunger 27. When the slide is pushed by the plunger, against the action of a compression coil spring 31, the slide moves underneath the lowermost toy bomb, so as to cause the opening 32 of the slide to be brought underneath the toy bomb, which then simply drops out therethrough, and outwardly of the toy airplane. The number of toy bombs that drop out of the airplane depends upon how long the plunger is held depressed. When the plunger is released, the compression coil spring pushes the slide back to its original position, so as to prevent further toy bombs from dropping.

Figure 4:
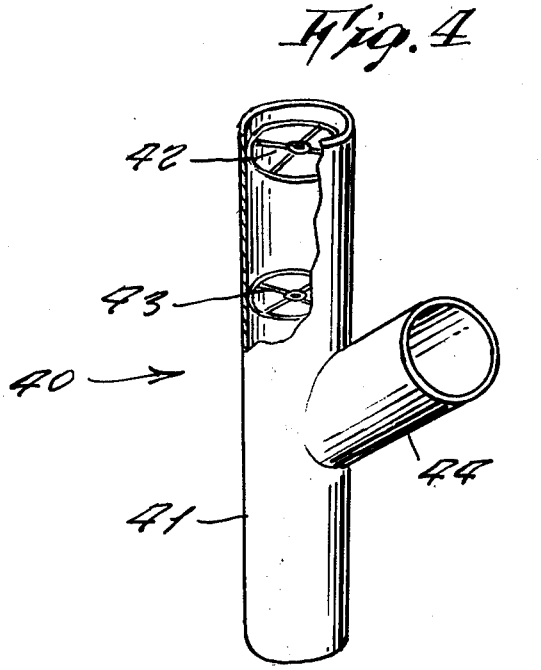
FIG. 4 is a perspective view, shown partly in cross-section, and illustrating a hand-held bomb sight, for use instead of an airplane shown in FIG. 1.
Figure 5:
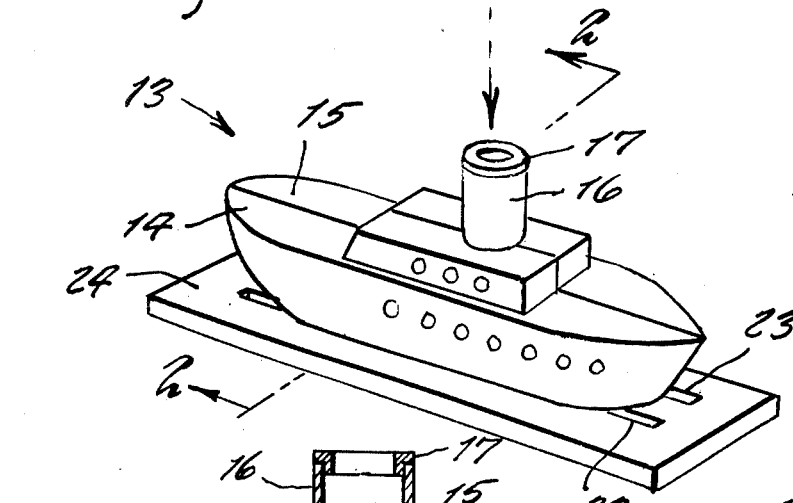
FIG. 5 is a cross-sectional view of the bomb sight of FIG. 4.
Figure 5:
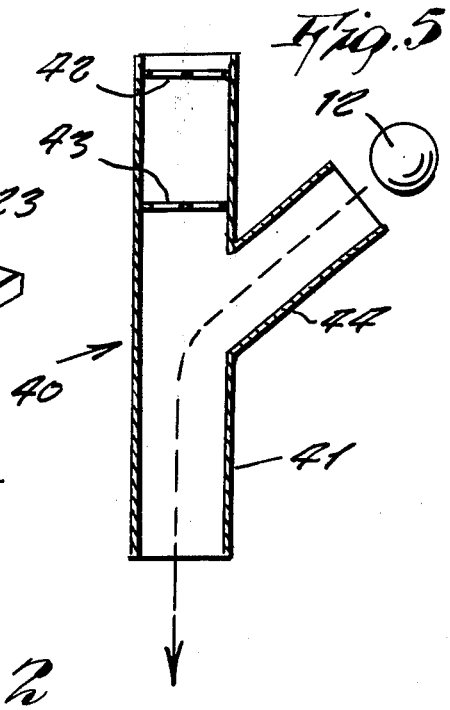

In FIGS. 4 and 5, a hand-held bomb sight 40 is shown, which can be used in substitution of the airplane 11, for dropping the toy bombs down upon the target. The hand-held bomb sight 40 includes a vertical tube 41, which, at its upper portion, includes, vertically spaced apart, cross-hairs 42 and 43, so that a child, looking downwardly therethrough, can aim the bomb sight toward a target. An angularly inclined side tube 44 is integral with an intermediate portion of vertical tube 41, and serves for the toy bombs 12 to be dropped thereinto, and outwardly of a lower end of the tube 41, while a child is taking aim toward the target, as is clearly shown in FIG. 5.

Figure 10:
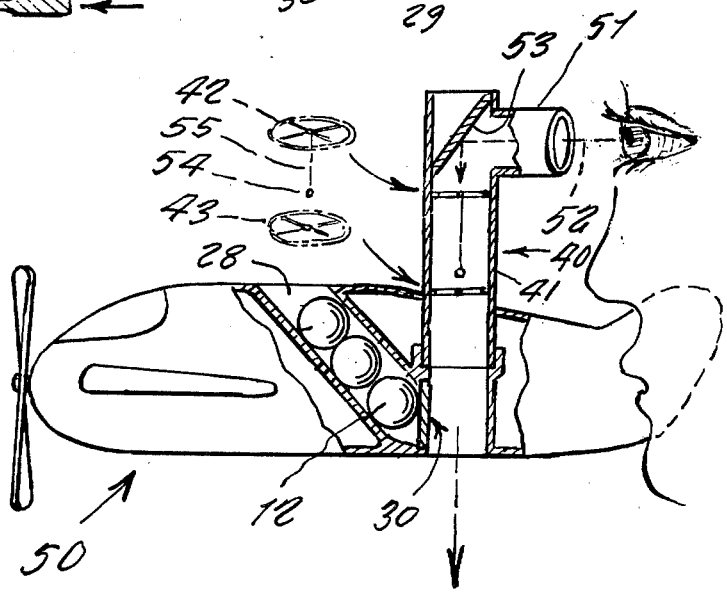
FIG. 10 is a side elevation view of a modified design of toy airplane, illustrated partly in cross-section, and which comprises generally a combination of an airplane and a bomb sight.

In FIG. 10, there is shown a modified design of toy bombing airplane 50, that is a general combination of the above described airplane 11, and the bomb sight 40, along with certain modifications in the structures of both. In this design, the above described slide 30 is tilted on its side, in order to be out of the way of a lower end of the bomb sight 40. The reason for this is that the bomb sight of this form of the invention additionally includes a periscope 51, in which a line of sight 52, by a child strikes, against a mirror 53, and then downwardly through a center of the vertical tube 41. Thus, the target can be seen, prior to releasing the toy bombs.

The advantage of this bomb sight is that the child does not have to look down through the upper end of the bomb sight toward the target, but can look through the side thereof, due to the periscope, so that the bomb sight can be held higher above the target by the child. Thus, to the child, it appears to be a more intricate instrument.

It is to be noted, that the bomb sight, shown in FIG. 10, is additionally made more accurate, by including a small weight 54, suspended freely on a thin string 55, supported from the upper of the cross-hairs 42, so that the weight 54 can thus be aligned with the center of the lower cross-hair 43. Accordingly, the bombing accuracy is much improved, because the bomb sight is thus held truly vertically over the target, when the child sees the image of the target within the periscope mirror. Thus, the force of gravity against a freely hanging weight is employed, for obtaining a vertical line through the bomb sight.

While various changes may be made in the detail construction, it is understood that such changes will be within the spirit and scope of the present invention, as is defined by the appended claims.

What I now claim is:

1. A toy game, comprising, in combination, a hand-held unit, a toy target located spaced below said hand-held unit, and a plurality of toy bombs for being released from said hand-held unit, for dropping upon said target; said toy bombs each comprising a spherical ball or marble made of metal, so as to have weight; said target comprising a toy structure having an upwardly extending smokestack, having a central opening therethrough, said toy target comprising right and left side members, held together at the top by a latch mechanism located underneath said smokestack, and held together at the bottom thereof by a keel on an underside of each said member, fitting in one of a pair of parallel grooves formed on a platform, on which said members rest, so that said latch mechanism is released when said toy bomb enters said central opening and strikes said latch mechanism, and a compression coil spring between said right and left side members spreading said members apart, when said latch mechanism is opened.

2. The combination as set forth in claim 1, wherein said hand-held unit comprises a bomb sight, consisting of a vertical straight tube, which, at its upper portion, includes a pair of spaced-apart cross-hairs, said unit further comprising an angularly inclined side tube being integral with an intermediate portion of said vertical tube, said side tube receiving said toy bombs.

3. The combination as set forth in claim 1, wherein said hand-held unit comprises a toy airplane supporting a plurality of said toy bombs in a downwardly inclined chute thereof, said toy bombs being retained within said chute by means of a sidewardly slideable slide, integral with a sidewardly extending plunger, an opening through said slide being aligned with said toy bombs for passage therethrough, when said plunger is depressed, a vertical bomb sight extending upwardly through said toy airplane, a lower end of said bomb sight communicating with said chute through said opening in said slide, said bomb sight including a periscope mirror in an upper end thereof directing a line of sight from a horizontal plane downwardly through said bomb sight.

4. The combination as set forth in claim 1, where said hand-held unit comprises a toy airplane having a downwardly inclined chute in which a plurality of said toy bombs are held, a lowermost of said toy bombs being supported upon a slide integral with a sidewardly extending plunger for moving said slide below said lowermost toy bomb and alignment of said bomb with an opening through said slide.

* * * * *